US012680539B2

(12) United States Patent
Chen

(10) Patent No.: US 12,680,539 B2
(45) Date of Patent: Jul. 14, 2026

(54) GAS INFLATION DEVICE

(71) Applicant: Chongqing Maiyi Technology Co., Ltd., Chongqing (CN)

(72) Inventor: Zhuo Chen, Chongqing (CN)

(73) Assignee: Chongqing Maiyi Technology Co., Ltd., Chongqing (CN)

( * ) Notice: Subject to any disclaimer, the term of this patent is extended or adjusted under 35 U.S.C. 154(b) by 0 days.

(21) Appl. No.: 19/026,810

(22) Filed: Jan. 17, 2025

(65) Prior Publication Data

US 2026/0132777 A1 May 14, 2026

(30) Foreign Application Priority Data

Nov. 14, 2024 (CN) ..... 202422778477.4

(51) Int. Cl.
*F04B 39/06* (2006.01)
*F04B 35/06* (2006.01)
*F04B 39/00* (2006.01)

(52) U.S. Cl.
CPC ..... *F04B 39/066* (2013.01); *F04B 35/06* (2013.01); *F04B 39/0044* (2013.01)

(58) Field of Classification Search
CPC ..... F04B 39/066; F04B 39/121; F04B 39/06; F04D 25/082; F04D 29/5806; F04D 25/06; F04D 19/002
USPC ..... 417/234
See application file for complete search history.

(56) References Cited

U.S. PATENT DOCUMENTS 3,650,639 A * 3/1972 Greene ..... F04B 39/066 417/413.1
4,492,533 A * 1/1985 Tsuge ..... F04B 39/066 417/372
5,397,950 A * 3/1995 Norbury, Jr. ..... H02K 1/187 310/58
9,624,924 B2 * 4/2017 Chou ..... F04B 35/04
9,759,207 B2 * 9/2017 Chou ..... F04B 39/127
12,006,928 B2 * 6/2024 Yang ..... F04D 25/082
2004/0018098 A1 * 1/2004 Beckman ..... F04B 39/066 417/373
2009/0194177 A1 * 8/2009 Yokota ..... F04B 49/06 137/565.18
2011/0158828 A1 * 6/2011 Nutz ..... F04B 41/02 417/234
2013/0228316 A1 * 9/2013 Hong ..... F04B 39/066 165/121

(Continued)

*Primary Examiner* — Mark A Laurenzi
*Assistant Examiner* — Benjamin Doyle

(57) ABSTRACT

A gas inflation device is provided, belonging to the technical field of gas inflation devices. The gas inflation device includes the housing, the heat dissipation chamber, the gas inflation pump, and the heat dissipation fan, wherein the housing is provided with the gas inlet and the gas outlet; the heat dissipation chamber is arranged in the housing, and the heat dissipation chamber is communicated to the gas inlet and the gas outlet respectively; the gas inflation pump is arranged in the heat dissipation chamber; the heat dissipation fan is arranged in the heat dissipation chamber and connected to the gas inflation pump; and the gas inflation pump is configured to drive the heat dissipation fan to rotate, so as to drive the gas flow from the gas inlet to the gas inflation pump and flow out via the gas outlet.

14 Claims, 4 Drawing Sheets

(56) References Cited

U.S. PATENT DOCUMENTS

| | | | | |
|---|---|---|---|---|
| 2015/0147208 | A1* | 5/2015 | Chen | F04B 39/0094<br>417/423.8 |
| 2015/0337825 | A1* | 11/2015 | Chou | F04B 37/18<br>417/415 |
| 2015/0377230 | A1* | 12/2015 | Chou | F04B 39/066<br>417/415 |
| 2016/0123349 | A1* | 5/2016 | Wang | F04D 29/4226<br>415/175 |
| 2016/0208789 | A1* | 7/2016 | Chou | F04B 35/04 |
| 2016/0265522 | A1* | 9/2016 | Chou | F04B 39/121 |
| 2016/0265541 | A1* | 9/2016 | Chou | F04B 39/121 |
| 2018/0238314 | A1* | 8/2018 | Hong | F04B 39/127 |
| 2021/0017974 | A1* | 1/2021 | Lin | F04B 39/121 |
| 2021/0079930 | A1* | 3/2021 | Yang | H02K 9/06 |
| 2024/0167464 | A1* | 5/2024 | Deng | F04B 39/16 |

* cited by examiner

GAS INFLATION DEVICE

CROSS-REFERENCE TO RELATED APPLICATION

The present disclosure claims priority to Chinese patent application No. 2024227784774, filed with the Chinese Patent Office on Nov. 14, 2024, and entitled "GAS INFLATION DEVICE", the entire contents of which are incorporated herein by reference.

TECHNICAL FIELD

The present disclosure relates to the technical field of gas inflation devices, and in particular to a gas inflation device.

BACKGROUND ART

The gas inflation pump is also called the gas inflator, gas pump, and gas supplier. It works by the operation of a motor and is a type of gas inflation tool. The working principle of the gas inflation pump is that when the motor operates to extract the gas, the valve of the connector is opened by the atmospheric pressure, and the gas enters the inflator; and when inflating into the device to be inflated, the valve is closed by the gas pressure inside the inflator, and the gas enters into the device to be inflated. The gas inflation pump is used in a wide range, including cars, motorcycles, bicycles, rubber balls, paddle boards, rubber boats, etc. Currently, the gas inflation pump on the market generally has the problem of poor heat dissipation performance, which affects the service life and the continuity of the gas inflation work.

SUMMARY

A gas inflation device includes:

a housing, wherein the housing is provided with a gas inlet and a gas outlet;

a heat dissipation chamber, wherein the heat dissipation chamber is arranged in the housing, and the heat dissipation chamber is communicated to the gas inlet and the gas outlet respectively;

a gas inflation pump, arranged in the heat dissipation chamber; and a heat dissipation fan, wherein the heat dissipation fan is arranged in the heat dissipation chamber and connected to the gas inflation pump, and the gas inflation pump is configured to drive the heat dissipation fan to rotate, so as to drive the gas to flow from the gas inlet to the gas inflation pump and flow out via the gas outlet.

BRIEF DESCRIPTION OF DRAWINGS

In order to more clearly illustrate the technical solutions in the embodiments of the present disclosure, the drawings to be used in the embodiments will be briefly introduced below. It should be understood that the following drawings only show certain embodiments of the present disclosure, and therefore should not be regarded as a limitation of the scope. For a person of ordinary skill in the art, other relevant drawings can be obtained according to these drawings without inventive efforts.

MAIN REFERENCE NUMBERS

Figure 1:
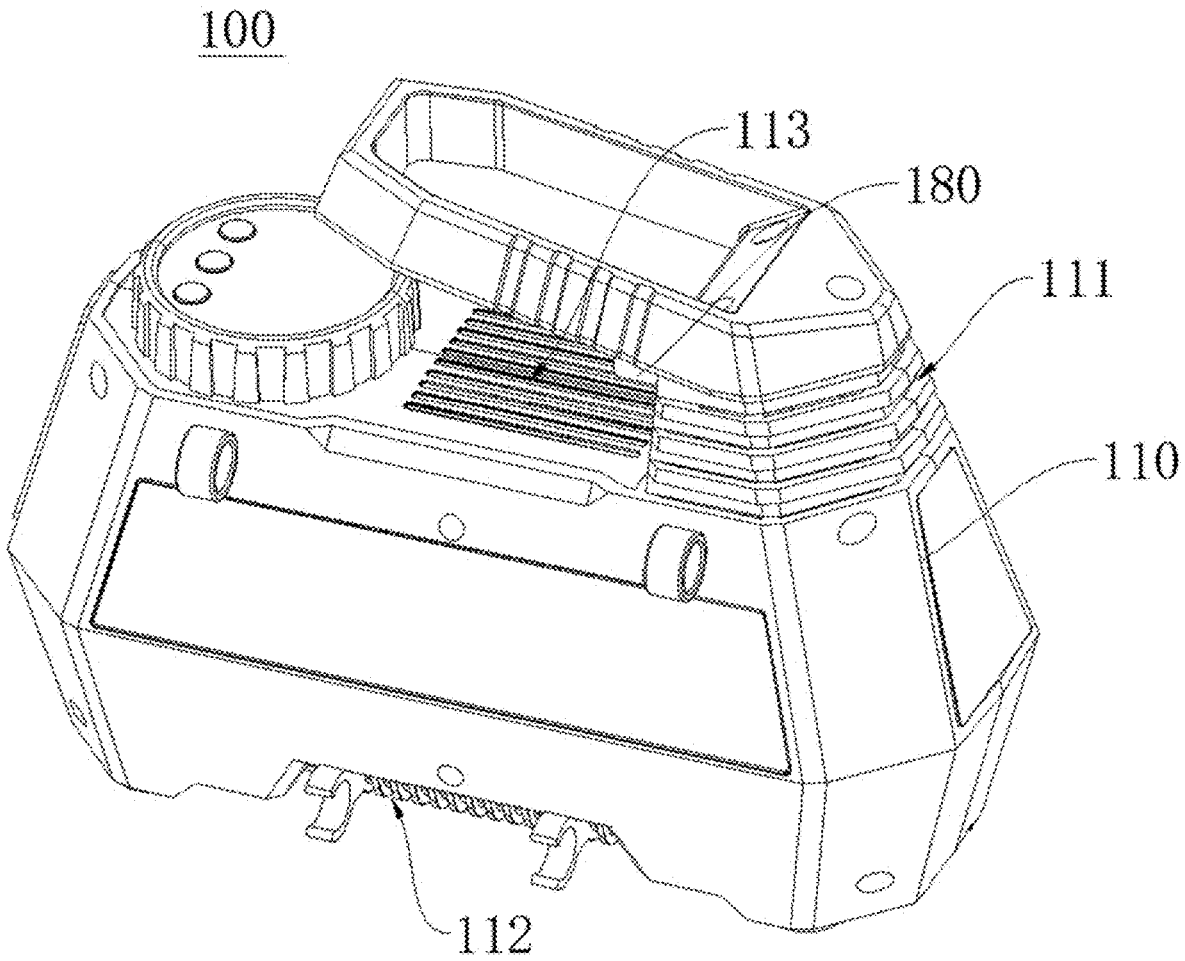
FIG. 1 shows a three-dimensional schematic diagram of a gas inflation device in some embodiments of the present disclosure.

100—gas inflation device;
110—housing; 111—gas inlet; 112—gas outlet; 113—gas extraction port;
120—heat dissipation chamber; 121—gas guide seat; 1211—first gas guide slot; 122—first avoidance hole; 123—second avoidance hole;
130—gas inflation pump;
140—heat dissipation fan;
150—buffer member; 151—second gas guide slot;
160—cavity body;
170—gas extraction tube; and
180—gas discharge tube.

DETAILED DESCRIPTION OF EMBODIMENTS

The embodiments of the present disclosure are described in detail below, and the examples of the embodiments are shown in the drawings, wherein the same or similar symbols throughout denote the same or similar components or components with the same or similar function. The embodiments described below referring to the drawings are exemplary and are intended only to explain the present disclosure and are not to be understood as a limitation of the present disclosure.

In the description of the present disclosure, it is to be understood that orientation or positional relationships indicated by terms, such as "center", "longitudinal", "transverse", "length", "width", "thickness", "up", "down", "front", "back", "left", "right", "vertical", "horizontal", "top", "bottom" "inside", "clockwise", "counterclockwise", "axial", "radial", and "circumferential" are the orientation or positional relationships based on the drawings, which are only to facilitate the description of the present disclosure and simplify the description, and are not to indicate or imply that the device or element referred to must have a particular orientation, or be constructed and operated with a particular orientation, and are not to be understood as limitations of the present disclosure.

Additionally, the terms "first" and "second" are used only for descriptions and are not to be understood as indicating or implying a relative importance or implicitly specifying the number of technical features indicated. Therefore, a feature defined by "first" or "second" can expressly or implicitly include one or more such features. In the description of the present disclosure, "plurality" means two or more, unless otherwise expressly and specifically limited.

In the present disclosure, unless other express specifications and limitations, the terms "mount", "connect", and "link" are to be understood in a broad sense. For example, it can be a fixed connection, a detachable connection, or an integral; it can be a mechanical connection or an electrical connection; it can be a direct connection, an indirect connection through an intermediate medium; and it can be a communication inside two components or interaction relationships between two components. For a person of ordinary skill in the art, the specific meaning of the above terms in the present disclosure can be understood according to specific situations.

In the present disclosure, unless otherwise expressly specifications and limitations, a first feature being "up" or "under" a second feature may include conditions that the first feature is directly in contact with the second feature, or the feature is indirectly in contact with the second feature by an intermediate medium. Moreover, the first feature being "above", "over", and "on top of" the second feature includes that the first feature is directly above and diagonally above the second feature, or simply indicates that the first feature is higher in horizontal height than the second feature. The first feature being "under", "below", and "beneath" the second feature includes that the first feature is directly below and diagonally below the second feature, or simply indicates that the first feature is smaller in horizontal height than the second feature.

In view of this, in order to overcome deficiencies in the prior art, the present disclosure provides a gas inflation device.

In order to solve the above technical problems, the present disclosure adopts the following technical solutions.

The embodiments of the present disclosure provide a gas inflation device, including:

- a housing, wherein the housing is provided with a gas inlet and a gas outlet;
- a heat dissipation chamber, wherein the heat dissipation chamber is arranged in the housing, and the heat dissipation chamber is communicated to the gas inlet and the gas outlet respectively;
- a gas inflation pump, arranged in the heat dissipation chamber; and
- a heat dissipation fan, wherein the heat dissipation fan is arranged in the heat dissipation chamber and connected to the gas inflation pump, and the gas inflation pump is configured to drive the heat dissipation fan to rotate, so as to drive the gas to flow from the gas inlet to the gas inflation pump and flow out via the gas outlet.

Additionally, the gas inflation device according to the present disclosure can have the following additional technical features.

In some embodiments of the present disclosure, the heat dissipation chamber is provided with at least one gas guide seat, and the gas guide seat can support the gas inflation pump.

In some embodiments of the present disclosure, the gas guide seat is provided with a first gas guide slot passing through it.

In some embodiments of the present disclosure, at least one first gas guide slot is provided, and the first gas guide slots are arranged at intervals.

In some embodiments of the present disclosure, the gas inflation device further includes a buffer member, wherein the buffer member abuts between the gas guide seat and the gas inflation pump.

In some embodiments of the present disclosure, one side of the buffer member close to the gas inflation pump is provided with a second gas guide slot passing through it.

In some embodiments of the present disclosure, at least one second gas guide slot is provided, and the second gas guide slots are arranged at intervals.

In some embodiments of the present disclosure, the gas inflation device further includes:

- a cavity body, wherein the cavity body is arranged in the housing, and the cavity body is adjacent to the heat dissipation chamber.

In some embodiments of the present disclosure, the gas inflation device further includes:

- a gas extraction tube, wherein a first avoidance hole is arranged on one side of the heat dissipation chamber adjacent to the cavity body, and a gas extraction port is arranged on a position of the housing corresponding to the cavity body, wherein one end of the gas extraction tube is connected to the gas inflation pump, and the other end passes through the first avoidance hole and extends into the cavity body.

In some embodiments of the present disclosure, the gas inflation device further includes:

- a gas discharge tube, wherein a second avoidance hole is arranged on the heat dissipation chamber; one end of the gas discharge tube is connected to the gas inflation pump; and the other end passes through the second avoidance hole and is arranged outside the housing.

Compared to the prior art, the present disclosure includes the following beneficial effects.

The present disclosure proposes a gas inflation device, and the gas inflation device includes the housing, the heat dissipation chamber, the gas inflation pump, and the heat dissipation fan, wherein the housing is provided with the gas inlet and the gas outlet, and the heat dissipation chamber is arranged in the housing and communicated to the gas inlet and the gas outlet respectively. The gas inflation pump and heat dissipation fan are both arranged in the heat dissipation chamber, and the heat dissipation fan is connected to the gas inflation pump, so that the gas inflation pump can drive the heat dissipation fan to rotate when the gas inflation device operates, so as to drive the external gas flow from the gas inlet to the gas inflation pump under the suction effect of the heat dissipation fan and to flow out via the gas outlet. Therefore, the heat generated by the work of the gas inflation pump is brought out, thereby realizing the heat dissipation and cooling function of the gas inflation pump. By arranging the heat dissipation chamber in the housing, on the one hand, it can play a guiding effect on the gas flow under the action of the heat dissipation chamber, which is conducive to the gas flow to quickly bring out the heat generated by the gas inflation pump inside the heat dissipation chamber; and on the other hand, it can further reduce the over-flow area of the gas flow, so as to greatly improve the suction rate when the suction power of the heat dissipation fan is not changed, thereby improving the suction rate of the heat dissipation fan, so that the gas flow quickly brings out the heat generated by the work of the gas inflation pump, which in turn effectively improves the heat dissipation performance of the gas inflation device, prolongs its service life, and ensures the continuity of the work of the gas inflation device.

In order to make the above purposes, features, and advantages of the present disclosure more obvious and easier to understand, the following is a detailed description of preferred embodiments in conjunction with the drawings.

Figure 2:
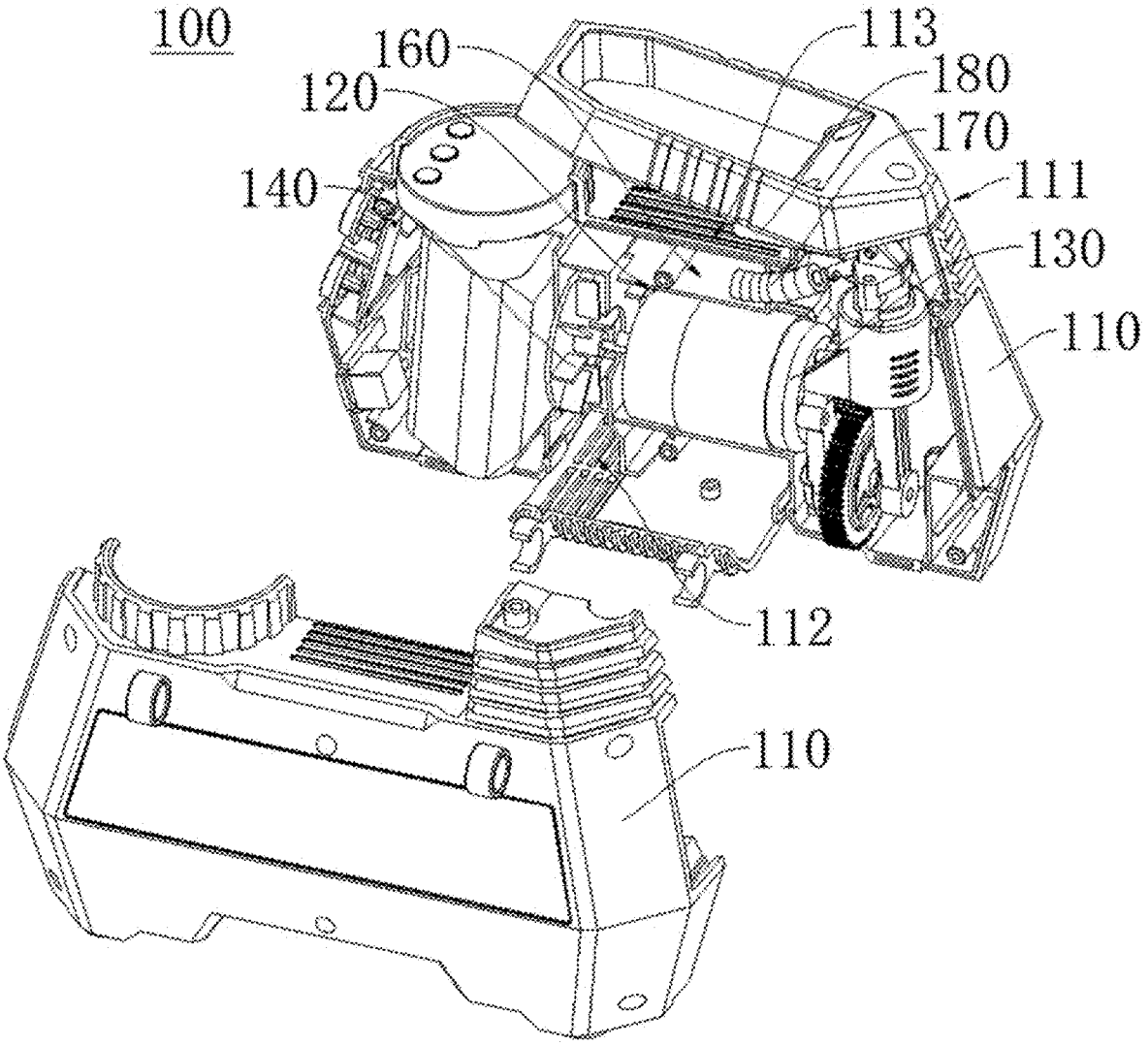
FIG. 2 shows a decomposition schematic diagram of a gas inflation device in some embodiments of the present disclosure.
Figure 3:
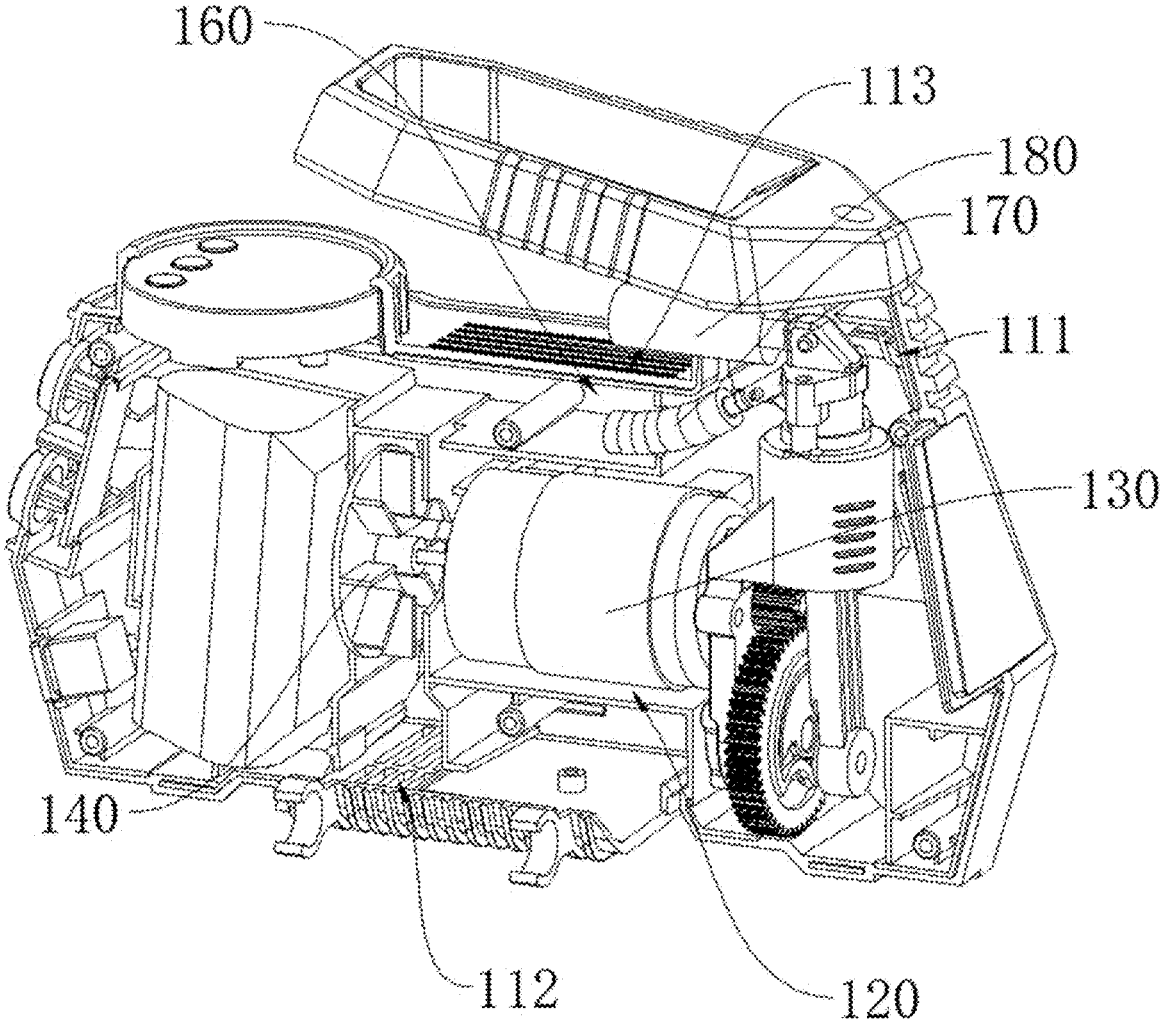
FIG. 3 shows a three-dimensional schematic diagram of a gas inflation device omitting partial housing in some embodiments of the present disclosure.

As shown in FIG. 1, FIG. 2, and FIG. 3, the embodiment of the present disclosure provides a gas inflation device 100. The gas inflation device 100 includes the housing 110, the heat dissipation chamber 120, the gas inflation pump 130, and the heat dissipation fan 140.

The housing 110 is provided with a gas inlet 111 and a gas outlet 112; the heat dissipation chamber 120 is arranged in the housing 110, and the heat dissipation chamber 120 is communicated to the gas inlet 111 and the gas outlet 112 respectively. The gas inflation pump 130 is arranged in the heat dissipation chamber 120, and the heat dissipation fan 140 is arranged in the heat dissipation chamber 120 and connected to the gas inflation pump 130. The gas inflation pump 130 is configured to drive the heat dissipation fan 140 to rotate, so as to drive the gas flow from the gas inlet 111 to the gas inflation pump 130 and flow out via the gas outlet 112.

In the gas inflation device 100 provided by the embodiments of the present disclosure, the gas inflation pump 130 and heat dissipation fan 140 are both arranged in the heat dissipation chamber 120, and the heat dissipation fan 140 is connected to the gas inflation pump 130, so that the gas inflation pump 130 can drive the heat dissipation fan 140 to rotate when the gas inflation device 100 operates, so as to drive the external gas flow from the gas inlet 111 to the gas inflation pump 130 under the suction effect of the heat dissipation fan 140 and to flow out via the gas outlet 112. Therefore, the heat generated by the work of the gas inflation pump 130 is brought out, thereby realizing the heat dissipation and cooling function of the gas inflation pump 130.

By arranging the heat dissipation chamber 120 in the housing 110, on the one hand, it can play a guiding effect on the gas flow under the action of the heat dissipation chamber 120, which is conducive to the gas flow to quickly bring out the heat generated by the gas inflation pump 130 inside the heat dissipation chamber 120; and on the other hand, it can further reduce the over-flow area of the gas flow, so as to greatly improve the suction rate under the condition that the suction power of the heat dissipation fan 140 remains unchanged, thereby improving the suction rate of the heat dissipation fan 140, Therefore, the gas flow quickly brings out the heat generated by the work of the gas inflation pump 130, which in turn effectively improves the heat dissipation performance of the gas inflation device 100, prolongs its service life, and ensures the continuity of the work of the gas inflation device 100.

Figure 4:
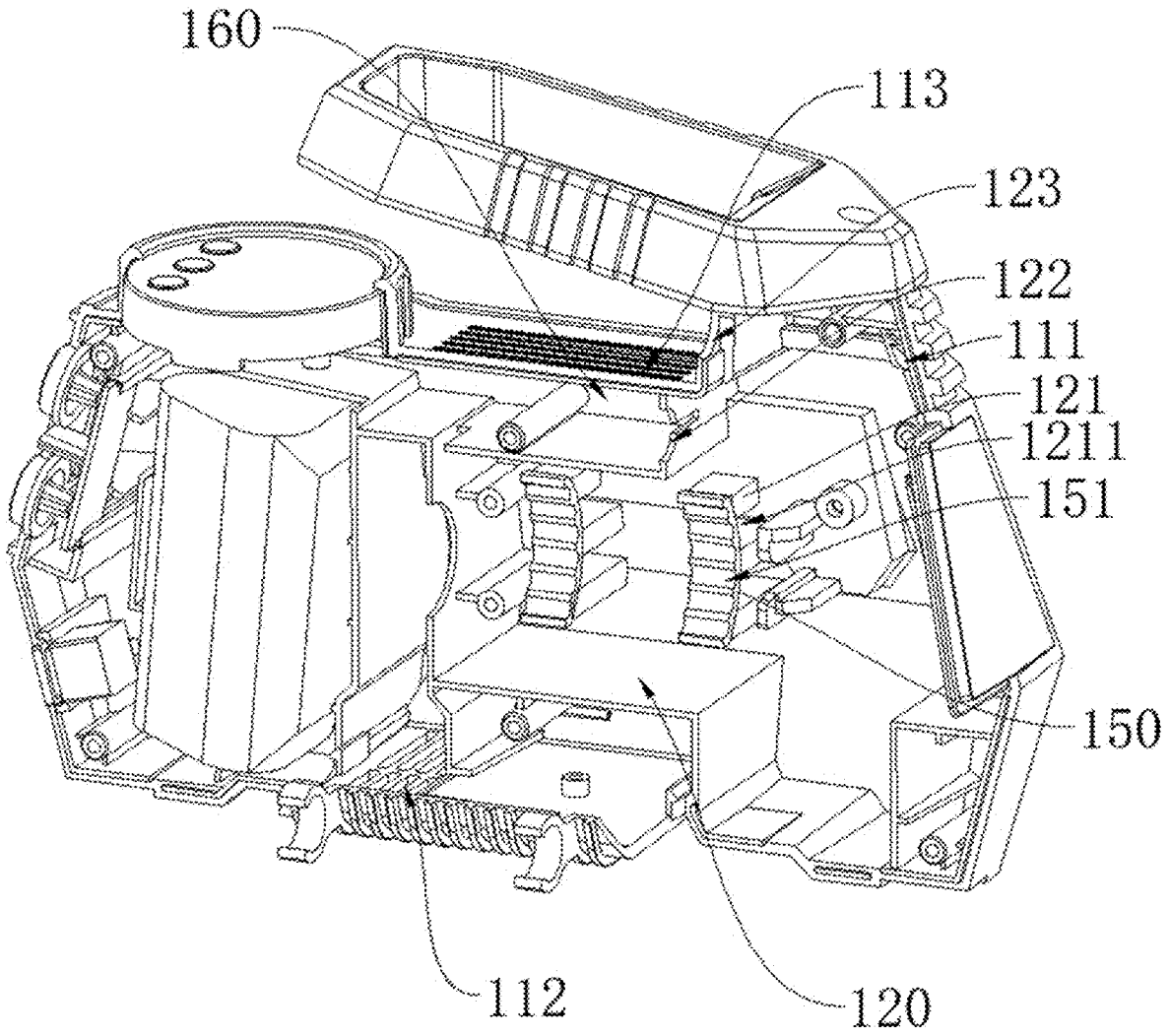
FIG. 4 shows a three-dimensional schematic diagram of a gas inflation device omitting partial housing, a gas inflation pump, and a heat dissipation fan in some embodiments of the present disclosure.

As shown in FIG. 3 and FIG. 4, in one embodiment of the present disclosure, the heat dissipation chamber 120 is provided with at least one gas guide seat 121, and the gas guide seat 121 can support the gas inflation pump 130.

In the embodiment, at least one gas guide seat 121 that can support the gas inflation pump 130 is arranged in the heat dissipation chamber 120, so that the gas inflation pump 130 is stably kept at the center position of the heat dissipation chamber 120 under the support of the gas guide seat 121, which is conducive to the contact of the periphery of the gas inflation pump 130 with the gas flow, so as to increase the contact area between the gas inflation pump 130 and the gas flow, thereby improving the heat dissipation efficiency to the gas inflation pump 130.

As shown in FIG. 3 and FIG. 4, in the above embodiment of the present disclosure, the gas guide seat 121 is provided with a first gas guide slot 1211 passing through it.

In the embodiment, the gas guide seat 121 is provided with the first gas guide slot 1211 passing through it, which can effectively reduce the shielding area of the gas guide seat 121 to the gas flow. Therefore, the gas flow can pass through the first gas guide slot 1211 of the gas guide seat 121 and flow to the heat dissipation fan 140 via the outer circumferential direction of the gas inflation pump 130, which further improves the heat dissipation efficiency to the gas inflation pump 130.

As shown in FIG. 3 and FIG. 4, in the above embodiment of the present disclosure, at least one first gas guide slot 1211 is provided, and the first gas guide slots 1211 are arranged at intervals.

In the embodiment, at least one first gas guide slot 1211 is provided, and the first gas guide slots 1211 are arranged at intervals so that it can further reduce the shielding area of the gas guide seat 121 to the gas flow. This facilitates the gas flow to pass through the first gas guide slot 1211 of the gas guide seat 121 and flow to the heat dissipation fan 140 via the outer circumferential direction of the gas inflation pump 130, which further improves the heat dissipation efficiency to the gas inflation pump 130.

As shown in FIG. 3 and FIG. 4, in the above embodiment of the present disclosure, the gas inflation device 100 further includes a buffer member 150, wherein the buffer member 150 abuts between the gas guide seat 121 and the gas inflation pump 130.

In the embodiment, by providing the buffer member 150 abutting between the gas guide seat 121 and the gas inflation pump 130, the vibration generated by the work of the gas inflation pump 130 is less transmitted to the gas guide seat 121, the heat dissipation chamber 120, the housing 110, and the user in sequence under the buffering and damping effect of the buffer member 150, so as to effectively improve the experience of the user.

Exemplarily, the buffer member 150 can be made of rubber or silicone.

As shown in FIG. 3 and FIG. 4, in the above embodiment of the present disclosure, one side of the buffer member 150 close to the gas inflation pump 130 is provided with a second gas guide slot 151 passing through it.

In the embodiment, one side of the buffer member 150 close to the gas inflation pump 130 is provided with the second gas guide slot 151 passing through it, which can effectively reduce the shielding area of the buffer member 150 to the gas flow, and can the increase the contact area between the gas flow and the circumferential wall of the gas inflation pump 130, so that the gas flow can pass through the second gas guide slot 151 of the buffer member 150 and flow to the heat dissipation fan 140 by tightly attaching the outer circumferential wall of the gas inflation pump 130, which further improves the heat dissipation efficiency to the gas inflation pump 130.

As shown in FIG. 3 and FIG. 4, in the above embodiment of the present disclosure, at least one second gas guide slot 151 is provided, and the second gas guide slots 151 are arranged at intervals.

In the embodiment, at least one second gas guide slot 151 is provided, and the second gas guide slots 151 are arranged at intervals, so that it can further reduce the shielding area of the buffer member 150 to the gas flow, and can further increase the contact area between the gas flow and the circumferential wall of the gas inflation pump 130, which facilitates that the gas flow passes through the second gas guide slot 151 of the buffer member 150 and flow to the heat dissipation fan 140 by tightly attaching the outer circumferential wall of the gas inflation pump 130, and further improves the heat dissipation efficiency to the gas inflation pump 130.

As shown in FIG. 3 and FIG. 4, in one embodiment of the present disclosure, the gas inflation device 100 further includes a cavity body 160, wherein the cavity body 160 is arranged in the housing 110, and the cavity body 160 is adjacent to the heat dissipation chamber 120.

The gas inflation device 100 further includes a gas extraction tube 170, wherein a first avoidance hole 122 is arranged on one side of the heat dissipation chamber 120 adjacent to the cavity body 160, and a gas extraction port 113 is arranged on a position of the housing 110 corresponding to the cavity body 160, wherein one end of the gas extraction tube 170 is connected to the gas inflation pump 130, and the other end passes through the first avoidance hole 122 and extends into the cavity body 160.

In the embodiment, the first avoidance hole 122 is arranged on one side of the heat dissipation chamber 120 adjacent to the cavity body 160, and the gas extraction port 113 is arranged on a position of the housing 110 corresponding to the cavity body 160, wherein one end of the gas extraction tube 170 is connected to the gas inflation pump 130, and the other end of the gas extraction tube 170 passes through the first avoidance hole 122 and extends into the cavity body 160. In this way, when the gas inflation pump 130 operates, the outside air can be extracted into the gas inflation pump 130 by sequentially passing through the gas extraction port 113, the cavity body 160, and the gas extraction tube 170.

As shown in FIG. 3 and FIG. 4, in the above embodiment of the present disclosure, the gas inflation device 100 further includes a gas discharge tube 180, wherein a second avoidance hole 123 is arranged on the heat dissipation chamber 120; one end of the gas discharge tube 180 is connected to the gas inflation pump 130; and the other end passes through the second avoidance hole 123 and is arranged outside the housing 110.

In the embodiment, the second avoidance hole 123 is arranged on the heat dissipation chamber 120; one end of the gas discharge tube 180 is connected to the gas inflation pump 130; and the other end of the gas discharge tube 180 passes through the second avoidance hole 123 and is arranged outside the housing 110. In this way, when the gas inflation pump 130 operates, the air in the gas inflation pump 130 can be discharged out via the gas discharge tube 180, thereby realizing the inflation for the device to be inflated.

In the description of the present specification, the description of reference terms, such as "an embodiment", "some embodiments", "example", "specific example", or "some examples", means that the specific features, structures, materials, or characteristics described in conjunction with the embodiment or example are included in at least one embodiment or example of the present disclosure. In the specification, the schematic expressions for the above terms do not necessarily refer to the same embodiments or examples. Moreover, the specific features, structures, materials, or characteristics described may be combined in a suitable manner in any one or more embodiments or examples. Additionally, without contradicting each other, a person skilled in the art may combine and combine different embodiments or examples and features of different embodiments or examples described in this specification.

Although embodiments of the present disclosure have been shown and described above, it can be understood that the above embodiments are exemplary and cannot be understood as a limitation of the present disclosure. A person of ordinary skill in the art can make changes, modifications, substitutions, and variations for the above embodiments within the scope of the present disclosure.

INDUSTRIAL APPLICABILITY

In the technical solutions provided by the present disclosure, the gas inflation pump and heat dissipation fan are both arranged in the heat dissipation chamber, and the heat dissipation fan is connected to the gas inflation pump, so that the gas inflation pump can drive the heat dissipation fan to rotate when the gas inflation device operates, so as to drive the external gas flow from the gas inlet to the gas inflation pump under the suction effect of the heat dissipation fan and to flow out via the gas outlet. Therefore, the heat generated by the work of the gas inflation pump is brought out, thereby realizing the heat dissipation and cooling function of the gas inflation pump. By arranging the heat dissipation chamber in the housing, on the one hand, it can play a guiding effect on the gas flow under the action of the heat dissipation chamber, which is conducive to the gas flow to quickly bring out the heat generated by the gas inflation pump inside the heat dissipation chamber; and on the other hand, it can further reduce the over-flow area of the gas flow, so as to greatly improve the suction rate under the condition that the suction power of the heat dissipation fan remains unchanged, thereby improving the suction rate of the heat dissipation fan. Therefore, the gas flow quickly brings out the heat generated by the work of the gas inflation pump, which in turn effectively improves the heat dissipation performance of the gas inflation device, prolongs its service life, and ensures the continuity of the work of the gas inflation device.

Furthermore, it will be appreciated that the gas inflation device provided by the embodiments of the present disclosure is reproducible, and can be applied in a variety of industrial applications. For example, the gas inflation device provided by embodiments of the present disclosure can be applied in the field involving the gas inflation device.

The invention claimed is:

1. A gas inflation device, comprising:

a housing, wherein the housing is provided with a gas inlet and a gas outlet;

a heat dissipation chamber, wherein the heat dissipation chamber is arranged in the housing, and the heat dissipation chamber is communicated to the gas inlet and the gas outlet respectively;

a gas inflation pump, wherein the gas inflation pump is arranged in the heat dissipation chamber; and a heat dissipation fan, wherein the heat dissipation fan is arranged in the heat dissipation chamber and connected to the gas inflation pump, and the gas inflation pump is configured to drive the heat dissipation fan to rotate, so as to drive a gas flow from the gas inlet to the gas inflation pump and flow out via the gas outlet;

a cavity body arranged in the housing, and the cavity body is adjacent to the heat dissipation chamber; and a gas extraction tube; and a gas extraction tube, wherein a first avoidance hole is arranged on one side of the heat dissipation chamber adjacent to the cavity body, and a gas extraction port is arranged on a position of the housing corresponding to the cavity body, one end of the gas extraction tube is connected to the gas inflation pump, and another end passes through the first avoidance hole and extends into the cavity body.

2. The gas inflation device according to claim 1, wherein the gas inflation device further comprises:

a gas discharge tube, wherein a second avoidance hole is arranged on the heat dissipation chamber, one end of the gas discharge tube is connected to the gas inflation pump, and another end passes through the second avoidance hole and is arranged outside the housing.

3. The gas inflation device according to claim 1, wherein, when the gas inflation pump operates, air is capable of being extracted into the gas inflation pump by sequentially passing through the gas extraction port, the cavity body, and the gas extraction tube.

4. The gas inflation device according to claim 2, wherein, when the gas inflation pump operates, the air in the gas inflation pump is capable of being discharged out via the gas discharge tube.

5. The gas inflation device according to claim 1, wherein the heat dissipation chamber is provided with at least one gas guide seat, and the gas guide seat is capable of supporting the gas inflation pump.

6. The gas inflation device according to claim 5, wherein the gas guide seat is provided with a first gas guide slot passing through the gas guide seat.

7. The gas inflation device according to claim 6, wherein at least one first gas guide slot is provided, and the first gas guide slots are arranged at intervals.

8. The gas inflation device according to claim 5, wherein the gas inflation device further comprises a buffer member, wherein the buffer member abuts between the at least one gas guide seat and the gas inflation pump.

9. The gas inflation device according to claim 8, wherein one side of the buffer member close to the gas inflation pump is provided with a second gas guide slot passing through the buffer member.

10. The gas inflation device according to claim 9, wherein the second gas guide comprise a plurality of second gas guide slots, and the plurality of second gas guide slots are arranged at intervals.

11. The gas inflation device according to claim 5, wherein the gas inflation pump is arranged at a center position of the heat dissipation chamber.

12. The gas inflation device according to claim 6, wherein the gas flow passes through the first gas guide slot of the gas guide seat and flows to the heat dissipation fan via an outer circumferential direction of the gas inflation pump.

13. The gas inflation device according to claim 8, wherein the buffer member is capable of being made of a rubber or silicone.

14. The gas inflation device according to claim 9, wherein the gas flow passes through the second gas guide slot of the buffer member and flows to the heat dissipation fan by tightly attaching an outer circumferential wall of the gas inflation pump.

* * * * *